US005601341A

United States Patent [19]

Merten et al.

[11] Patent Number: 5,601,341

[45] Date of Patent: Feb. 11, 1997

[54] DRIVE GEAR AND GUIDE ARRANGEMENT FOR A MINING MACHINE, IN PARTICULAR A DISK SHEARER

[75] Inventors: Gerhard Merten; Frank Fischer; Bernd Steinkuhl, all of Lünen, Germany

[73] Assignee: DBT Deutsche Bergbau-Technik GmbH, Germany

[21] Appl. No.: 441,266

[22] Filed: May 15, 1995

[30] Foreign Application Priority Data

Jul. 7, 1994 [DE] Germany ..... 44 23 925.4

[51] Int. Cl.[6] ..... E21C 29/10; E21C 35/12

[52] U.S. Cl. ..... 299/43; 198/735.1; 198/735.2

[58] Field of Search ..... 299/43, 34.1; 198/735.1, 198/735.2

[56] References Cited

U.S. PATENT DOCUMENTS 5,131,723 7/1992 Roling ..... 299/43
5,272,289 12/1993 Cocksedge ..... 299/43

FOREIGN PATENT DOCUMENTS 2523639 9/1983 France .
2953955 4/1981 Germany .
3622110 1/1986 Germany .

*Primary Examiner*—David J. Bagnell
*Attorney, Agent, or Firm*—Vickers, Daniels & Young

[57] ABSTRACT

A drive gear and guide arrangement for a mining machine such as a disk shearer which operates above a chain scraper conveyor. The guide arrangement includes a guide rail arranged on a trough section of the chain scraper conveyor and extends along side of the chain scraper conveyor forming a chain duct for a drive gear chain which moves the mining machine along the conveyor. The guide rail includes a profile lug which engages over the horizontal chain links of the drive gear chain and holds the chain links on a chain support in the chain duct. The guide rails also includes a rolled profile which forms a sealing strip that closes off the chain duct of the drive gear chain on the side of the conveyor. The chain duct includes opening on the storing side which are designed to discharge fine materials which enter the trough section.

57 Claims, 2 Drawing Sheets

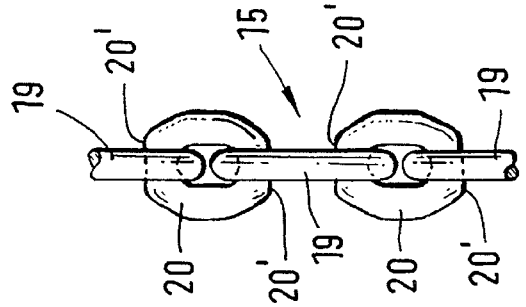
FIG. 3
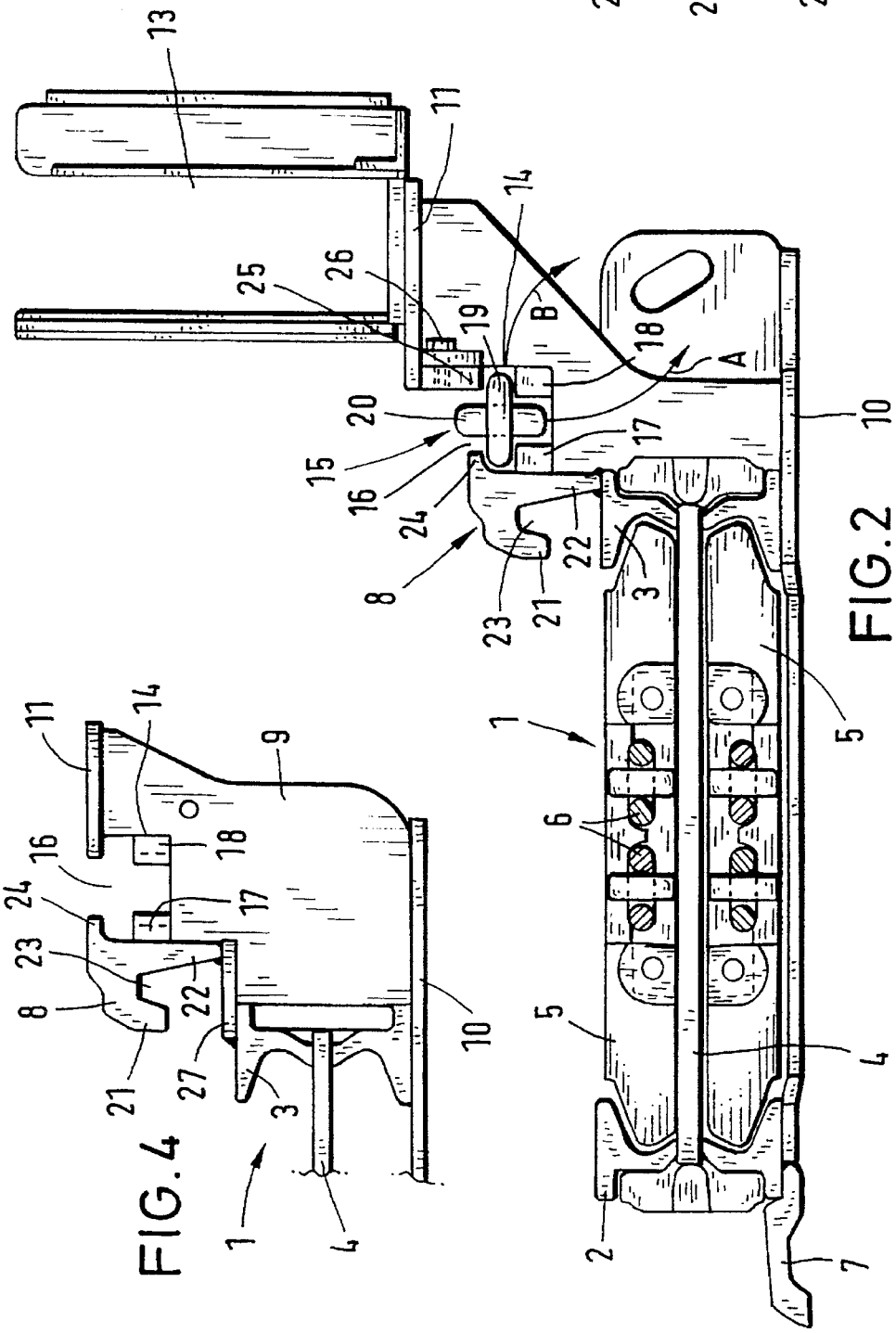
FIG. 2
FIG. 4

DRIVE GEAR AND GUIDE ARRANGEMENT FOR A MINING MACHINE, IN PARTICULAR A DISK SHEARER

The invention relates to a drive gear and guide arrangement for a mining machine, in particular a disk shearer, which operates above a chain scraper conveyor, with guide rails arranged on the trough sections of the chain scraper conveyor, on the stowing side, at a level above the trough sections, which guide rails extend alongside the chain scraper conveyor forming a chain duct for a drive gear chain for the moving forward of the mining machine, and are provided with profile lugs which engage over the horizontal chain links of the drive gear chain, holding these on their chain support in the chain duct.

Drive gear forward feed drives for disk shearers that move in the manner of a portal above the working face conveyor are known and commonly used in the mining industry. In this connection it is known to use as drive gear a drive gear chain which is arranged on the stowing side in a chain duct alongside the working face conveyor, which chain duct is open at the top so that the driven chain wheel or wheels of the disk shearer can engage into same. The disk shearer is guided on guide rails fixed on the stowing side to the trough sections of the working face conveyor, which guide rails at the same time serve to accommodate and hold in position the drive gear chain (DE-PS 29 53 955).

It is customary to produce the guide rails, which at the same time form the chain duct for the drive gear chain, as cast parts, the length of which, for weight and casting reasons, corresponds in each instance to about half the trough section length, so that two such cast guide rails must be mounted on every trough section. Cast onto the guide rails are inclined channels. which serve to discharge the fine material that during the conveying and mining flows from the top into the chain duct of the drive gear chain (DE-PS 29 53 955). However, these fine material discharge channels tend to block up, resulting in fine material accumulations in the narrow chain duct which holds the drive gear chain and impairing the proper engaging of the chain wheels in the drive gear chain. A complete clogging of the discharge channels may result in damages to the drive gear chain and also to the guides.

However, another arrangement is known with which the profile strips, which serve to accommodate and hold the drive gear chain and also as a guide for the disk shearer and also consist of cast parts which are short compared to the trough section length, are made in such a way that the fine material getting into the chain duct and settling on the bottom of the chain duct, is discharged, instead of onto the conveyor, to the stowing side of same (FR-PS 2 523 639). Besides the fact that the production of the profile strips as cast parts is expensive, another disadvantage here is that a drive gear chain must be used, the upright chain links of which must be provided with a widened holding base.

It is the object of the invention to design the drive gear and guide arrangement of the type mentioned at the outset in such a way that it can be produced with less manufacturing work and so that a reliable fine material discharge from the chain duct to the stowing side is ensured.

According to the invention this object is addressed in that the guide rails consist of rolled profiles which form a sealing strip that closes off the chain duct of the drive gear chain on the side of the conveyor, wherein the chain duct is open on the stowing side for the discharge of the fine material. The use of rolled profiles for the guide rails instead of the customary cast parts results in considerable cost savings as the price per kilogram of a cast profile is about twice as high as that of a rolled profile. The rolled guide rails used according to the invention form a continuous closed sealing strip over the entire length of the trough section, which closes off the chain duct holding the drive gear chain on its working face side. Instead, fine material getting into the chain duct from above is discharged from the chain duct to the stowing side, preferably at the bottom of the chain duct as well as at its stowing side side. The rolled guide rails, in which the disk shearer or the like is guided on the stowing side, are profiled in such a manner that they close off the chain duct only on the working face side, whereas the delimiting of the chain duct on its stowing side and at the bottom takes place by separate parts attached to the trough sections. The rolled guide rails have comparatively small dimensions and weights compared to the conventional cast profiles. Preferably, the arrangement is provided in such a way that the rolled guide rails each extend over about the entire trough section length.

In a preferred embodiment the guide rails are profiled roughly in the shape of a U-section with downwards extending legs of different lengths, wherein the longer stowing side leg forms the sealing strip and in the area underneath the chain duct is fixed, preferably by welding, to the trough section or to parts attached to the latter on its stowing side. The disk shearer may, as is known, have roughly hook-shaped guide shoes, which engage from below into the profile openings between the legs of the guide rails. The disk shearer may also, as is also known, run on the top surface of the guide rails by means of runners.

In detail, the arrangement may advantageously be provided in such a way that the rolled guide rails rest with their base or with their leg which forms the sealing strip on the trough section side profile on the stowing side. In this case the chain duct accommodating the drive gear chain may be positioned close to the side profiles of the trough sections on the stowing side. On the other hand, it is also possible to fasten, preferably by welding, support plates projecting to the stowing side to the top flanges of the stowing side side profiles of the trough sections, on which the rolled-profile strips can rest at a lateral distance from the said side profiles.

As mentioned, the arrangement is expediently provided in such a way, that the chain ducts for the drive gear chain are formed on their stowing side and at their bottom by separate parts attached to the trough sections on the stowing side, which parts form the fine material outlet openings, and to which parts the rolled guide rails can be fixed by welding. The said attachable parts can be constructed in such a way that very large openings are formed for the discharge of the fine material that gets into the chain duct.

In another embodiment of the invention the chain support for the horizontal chain links of the drive gear chain is formed by parallel support strips arranged at a lateral distance from one another, preferably continuous over the trough section length, in such a way that the upright chain links of the drive gear chain engage into the gap-like space between the support strips. Simple strips with a rectangular profile can be used for the support strips. It is furthermore recommended to arrange on the stowing side of the chain duct, in a detachable manner, holding down strips or the like, which cover the stowing side legs of the horizontal chain links of the drive gear chain and accordingly prevent the drive gear chain from lifting out of the chain duct. The holding down strips, which expediently also extend over the entire trough section length, can be fixed to the attachable parts by screwing. When the holding down strips are loosened, the drive gear chain can be placed from above in the chain duct, or when changing the chain it can be lifted upwards out of the chain duct.

With a preferred embodiment of the invention upwards projecting support plates or bracket plates are fastened, preferably by welding, as attachable parts, at a distance from one another to the stowing side side profiles of the trough sections, which plates have recesses which delimit the chain duct of the drive gear chain on the stowing side and at the bottom, wherein the spaces between these bracket plates form the fine material outlet openings. The rolled guide strips can, with their legs that form the sealing strips, be fixed to the bracket plates by welding. The bracket plates carry a cable duct which can hold the cable of the disk shearer. The support strips which serve to support the horizontal chain links of the drive gear chain are expediently fastened resting on the bottom of the said recesses of the bracket plates, whilst the aforementioned holding down strip can be fastened in a detachable manner resting against the stowing side side edge of the recess.

For the drive gear chain preferably a chain is used, the upright chain links of which do not have a holding base. Particularly suitable is a drive gear chain as known from the DE-OS 36 22 110 (FIGS. 4 to 6), to the disclosure content of which reference is made here.

Further advantageous design characteristics of the invention are indicated in the individual claims and can be noted from the following description of the exemplified embodiments illustrated in the drawing, wherein:

FIG. 2 is a front view of FIG. 1 in the direction of the arrow II of FIG. 1;

FIG. 3 shows a short chain part of a drive gear chain used preferably for the drive gear and guide arrangement according to the invention;

FIG. 4 shows in the view of FIG. 2 a slightly modified embodiment of the invention, wherein only the stowing side part of the trough section is shown.

Figure 1:
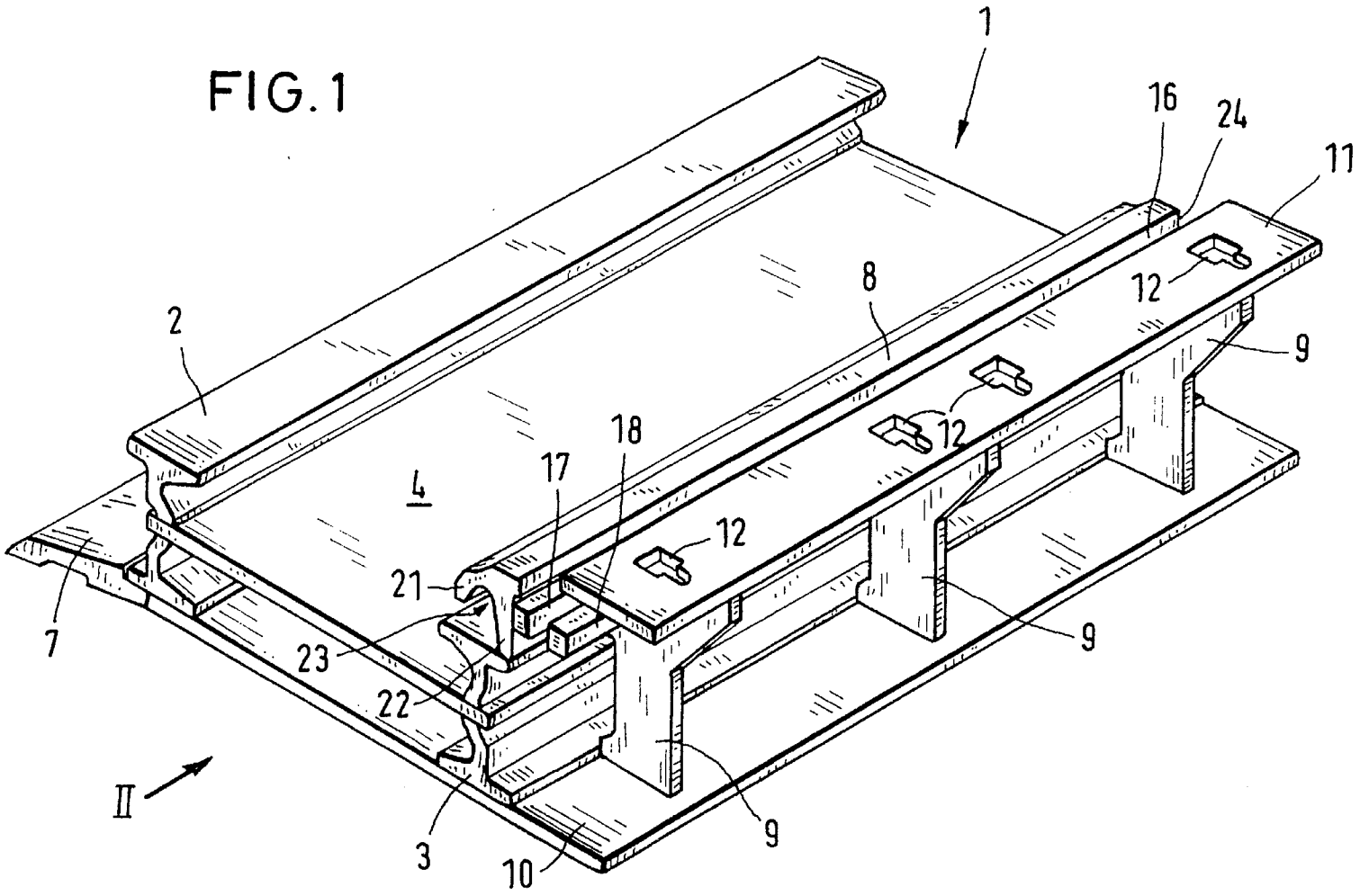
FIG. 1 is a view in perspective of one single trough section of a chain scraper conveyor with a drive gear and guide arrangement according to the invention attached to the trough section on the stowing side.

The chain scraper conveyor used as working face conveyor in underground mines consists, as usual, of individual trough sections connected to one another in a tension-proof manner, but in such a way that they can perform a limited angle movement relative to one another. Only one of these trough sections 1 with its attachable parts is illustrated in the drawing. The disk shearer which during the mining of the coal moves in a portal-like manner above the chain scraper conveyor is not illustrated, as the construction and mode of operation of these mining machines are generally known. The trough sections 1, which together form the conveying trough of the chain scraper conveyor, each consist of side profiles 2 and 3 arranged mirror symmetrical to one another and connected by the conveying bottom 4. Shown only in FIG. 2 is the endless scraper chain belt fitted with the scrapers 5, which belt in this case consists of a double chain belt 6. At the base of the working face or coal face side side profile 2 of the trough section 1, as known, a sliding rail 7 is provided on which the disk shearer is supported and guided by means of runners or skids. The disk shearer, which bridges the chain scraper conveyor in a portal-like manner, is guided on the stowing side on guide rails 8, which are fixed at a height above the trough section 1 and its stowing side side profiles 3 and form part of a drive gear and guide arrangement. According to FIG. 1, the guide rails 8 each extend essentially over the entire trough section length and consist of rolled profiles.

To the stowing side side profiles 3 of the trough sections 1 bracket plates 9 projecting above the trough sections are welded on as attachable parts, the base of which bracket plates 9 is connected to a cover plate 10 extending over the trough section length, which at the same time forms a cover for the empty rim of the trough sections. As illustrated in FIG. 1, the bracket plates 9 consisting of support plates are arranged on every trough section 1 at a distance from one another in its longitudinal direction, wherein in the illustrated exemplified embodiment every trough section has three bracket plates 9 arranged at a parallel distance from one another. The bracket plates 9 carry at the top a top plate 11, which according to FIG. 1 has keyhole shaped bolt holes 12 for screw bolts with the aid of which a cable duct 13 (FIG. 2) can be fastened onto the top plate 11, which cable duct 13, as is known, serves to hold the shearer cable.

The bracket plates 9 are provided, above the side profiles 3 of the trough sections 1, with rectangular recesses 14, which on the stowing side as well as at the bottom delimit a chain duct 16 which holds a drive gear chain 15. On the working face side the chain duct 16 is delimited on every trough section 1 by the upwards projecting guide rail 8. In the chain duct 16 of the trough sections 1 two support strips 17 and 18 are arranged at a lateral distance from one another, extending over the length of the trough section, and resting on the bottom of the chain duct 16 on the horizontal edges of the angle-shaped recesses 14, where they are fixed to the bracket plates 9, e.g. by welding. The support strips consist of simple rectangular strips; they form a chain support for the horizontal chain links 19 of the drive gear chain 15. The upright or vertical chain links 20 of the drive gear chain 15 engage with their bottom chain link leg in the gap-like space between the two support strips 17 and 18, as can be noted from FIG. 2.

The rolled guide rails 8, which on every trough section 1 delimit the chain duct 16 only on its stowing side, are profiled at least roughly in the shape of a U-section with downwards extending legs 21 and 22 of different lengths, wherein the longer leg 22 on the stowing side is welded to the faces of the bracket plates 9 projecting above the side profile 3. The guide opening 23 between the different size legs 21 and 22 serves for the engaging of roughly hook-shaped skids provided on the disk shearer, which engage around the leg 21 and fit into the guide opening 23 from below. In addition the disk shearer may be supported in a rolling manner by runners on the fiat top surface of the guide rails 8.

Rolled onto the upper part of the guide rails 8 on the side of the chain duct 16 are projecting strip-shaped profile lugs 24 which engage over the horizontal chain links 19 of the drive gear chain 15 and accordingly hold the chain links onto the supports strips 17 and 18. Fastened in a detachable manner by means of screws 26 to the bracket plates 9 of the trough sections are holding-down strips 25 which engage over the horizontal chain links 19 of the drive gear chain 15 on their stowing side and therefore, together with the profile lugs 24, hold the drive gear chain 15 on the chain supports 17, 18 and protect the chain 15 from lifting out of the open chain duct. Preferably, the holding-down strips 25 also extend essentially over the entire length of the trough section. When the holding-down strips 25 are loosened, the drive gear chain 15 can be put into the chain duct 16 of the trough sections from above, or if the chain has to be replaced it can be lifted upwards out of the chain duct.

With the embodiment according to FIGS. 1 and 2 the guide rail 8 rests with the base of its longer leg 22 on the head or top flange of the stowing side trough section side profile 3, and here can at the same time be welded to the side profile. The guide rails 8 consisting of a rolled profile form with their longer legs 22 a sealing strip which closes off the chain duct 16 on the working face or conveying side. For the rest, the chain duct 16 is open at the bottom on every trough section, so that fine material which gets from above into the chain duct 16 during the mining and conveying operations, is discharged from the chain duct downwards to the stowing side in the direction of arrow A. This outlet cross-section for the fine material is large, as between the bracket plates 9 arranged at a relatively large distance from one another the chain duct 16 is open to the bottom. The fine material outlet openings at the bottom of the chain duct 16 extend practically over the entire trough section length. To a certain extent fine material that has got into the chain duct 16 can also be discharged to the stowing side at the stowing side edge of the chain duct 16, i.e. through the space between the support strip 18 and the holding-down strip 25 positioned above same, in the direction of arrow B.

It will be noted that the fine material outlet openings for the discharge of fine material from the chain duct are formed not by the guide rail 8, but by parts attached to the trough sections 1 on the stowing side, i.e. the bracket plates 9 with the described connected elements. Whereas with the embodiment according to FIGS. 1 and 2 the rolled profile rails 8 rest on the stowing side side profiles 3 of the trough sections 1 and are welded to same as well as to the bracket plates, FIG. 4 shows an arrangement with which the correspondingly shaped, rolled guide rail 8 rests with the free end of its longer leg 22 on a support plate 27, which rests on the head or top flange of the stowing side side profile 3 and is fixed to same by welding, and in relation to the side profile 3 projects to the stowing side, and here it is welded to the bracket plates 9. The guide rail 8 welded to the support plate 27 and the bracket plates 9 is offset to the stowing side in relation to the side profile 3, so that compared to the arrangement of FIG. 1 and 2 the chain duct is positioned at a somewhat larger lateral distance from the trough section.

For the drive gear chain 15 a type of round link chain is used, the upright chain links 20 of which at their bottom chain link leg do not have a holding foot for securing the chain. Preferably, for the drive gear chain 15 a chain is used, as is known from the DE-OS 36 22 110 (FIGS. 4 to 6). With this drive gear chain the horizontal chain links 19, which serve to engage the chain wheel and made in the manner of the chain links of round link chains, have a greater length and pitch than the upright chain links 20, the outer end faces 20' of which according to FIG. 3 are flat surfaces extending roughly orthogonally to the chain axis, which ensures more favourable engaging conditions between the chain wheel teeth and the chain links. For the rest, reference is made in this connection to the disclosure content of the DE-OS 36 22 110.

It may be expedient to close off the fine material discharge opening at the bottom of the chain duct 16 by means of a flexible sealing strip, e.g. a robber strip or the like, which only opens the fine material discharge opening between the bracket plates during the moving past of the disk shearer, so that the fine material can flow off to the stowing side in the direction of arrow A. It is also possible to arrange such a sealing strip above the cable duct 13, which therefore normally closes off the upper engaging opening of the chain duct, protecting it against the getting in of fine material. In this case the shearer has a lifting strip or the like, which in the operating range of the disk shearer lifts the sealing or cover strip into the open position, so that the driven chain wheel or wheels of the disk shearer can engage with the drive gear chain.

We claim:

1. A drive gear and guide arrangement for a mining machine, which operates above a chain scraper conveyor, having a guide rail arranged on a trough section of said chain scraper conveyor, on the stowing side, at a level above said trough section, said guide rail extending alongside said chain scraper conveyor forming a chain duct for a drive gear chain for the moving forward of said mining machine, said guide rail including a profile lug which engages over horizontal chain links of said drive gear chain and holds said chain links on a chain support in said chain duct, said guide rail having a rolled profile which forms a sealing strip that closes off said chain duct of the drive gear chain on the side of the conveyor, said chain duet open on said stowing side for discharge of fine material, said guide rail profiled roughly in the shape of a U-section with downward extending legs of different lengths, wherein the longer stowing side leg forms a sealing strip and in the area underneath said chain duct, said leg being fixed to said trough section or to parts attached to the latter on its stowing side by welding.

2. An arrangement as defined in claim 1, wherein said mining machine is a disk shearer.

3. An arrangement as defined in claim 1, wherein said rolled guide rail extends over the entire length of said trough section.

4. An arrangement as defined in claim 1, wherein said chain duct is open at its bottom as well as at a stowing side delimitation for the discharge of said fine material to said stowing side.

5. An arrangement as defined claim 1, wherein said rolled guide rail rests with its base or with its leg which forms said sealing strip on the trough section side profile on said stowing side.

6. An arrangement as defined in claim 1, wherein said rolled guide rail having a leg forming the sealing strip, and resting on a support plate which is fastened to the top of said stowing side profile of said trough sections and forming, on said stowing side, widened parts of said side profile.

7. An arrangement as defined in claim 1, wherein said chain duct for said drive gear chain is formed on its stowing side and at its bottom by separate parts attached to said trough sections which parts form a fine material outlet opening, and to which parts said rolled guide rail is fixed by welding.

8. An arrangement as defined in claim 1, wherein said chain support for said horizontal chain links of said drive gear chain is formed by support strips arranged at a lateral distance from one another such that upright chain links of said drive gear chain engage in a gap-like space between said support strips.

9. A drive gear and guide arrangement for a mining machine, which operates above a chain scraper conveyor, having a guide rail arranged on a trough section of said chain scraper conveyor, on the stowing side, at a level above said trough section, said guide rail extending alongside said chain scraper conveyor forming a chain duct for a drive gear chain for the moving forward of said mining machine, said guide rail including a profile lug which engages over horizontal chain links of said drive gear chain and holds said chain links on a chain support in said chain duct, said guide rail having a rolled profile which forms a sealing strip that closes off said chain duct of the drive gear chain on the side of the conveyor, said chain duct open on said stowing side for discharge of fine material, and said rolled guide rail resting with its base or with its leg which forms said sealing strip on said trough section side profile on said stowing side.

10. An arrangement as defined in claim 9, wherein said rolled guide rail extending over the entire length of said trough section.

11. An arrangement as defined in claim 9, wherein said chain duct is open at its bottom as well as at a stowing side delimitation for the discharge of said fine material to said stowing side.

12. An arrangement defined in claim 9, wherein said guide rail is profiled roughly in the shape of a U-section with downwards extending legs of different lengths, wherein the longer stowing side leg forms a sealing strip and in the area underneath said chain duct and is fixed to said trough section or to parts attached to the latter on its stowing side.

13. An arrangement as defined in claim 9, wherein said rolled guide rail having a leg forming the sealing strip, and resting on a support plate which is fastened to the top of said stowing side profile of said trough sections and forming, on said stowing side, widened parts of said side profile.

14. An arrangement as defined in claim 9, wherein said chain support for said horizontal chain links of said drive gear chain is formed by support strips arranged at a lateral distance from one another such that upright chain links of said drive gear chain engage in a gap-like space between said support strips.

15. An arrangement as defined in claim 14, including a chain duct holding down strip which covers the stowing side legs of said horizontal chain links of said drive gear chain, said holding down strip arranged in a detachable manner.

16. An arrangement defined in claim 15, wherein the stowing side profiles of the trough sections as attachable parts, upwards projecting bracket plates are fastened arranged at a distance from one another, which plates have recesses which delimit said chain duct on said stowing side and at the bottom, wherein the spaces between the bracket plates form said fine material outlet openings.

17. An arrangement as defined in claim 16, wherein said support strips are fastened resting on the bottom of the recesses of said bracket plates, and said holding down strip is fastened in a detachable manner resting against said stowing side edge of said recesses.

18. An arrangement as defined in claim 9, including a chain duct holding down strip which covers the stowing side legs of said horizontal chain links of said drive gear chain, said holding down strip arranged in a detachable manner.

19. An arrangement defined in claim 9, wherein the stowing side profiles of the trough sections as attachable parts, upwards projecting bracket plates are fastened arranged at a distance from one another, which plates have recesses which delimit said chain duct on said stowing side and at the bottom, wherein the spaces between the bracket plates form said fine material outlet openings.

20. An arrangement as defined in claim 9, wherein said horizontal chain links have a greater length and pitch than the upright chain links and have outer end faces which include flat surfaces extending roughly orthogonally to the axis of said drive gear chain.

21. A drive gear and guide arrangement for a mining machine, which operates above a chain scraper conveyor, having a guide rail arranged on a trough section of said chain scraper conveyor, on the stowing side, at a level above said trough section, said guide rail extending alongside said chain scraper conveyor forming a chain duct for a drive gear chain for the moving forward of said mining machine, said guide rail including a profile lug which engages over horizontal chain links of said drive gear chain and holds said chain links on a chain support in said chain duct, said guide rail having a rolled profile which forms a sealing strip that closes off said chain duct of the drive gear chain on the side of the conveyor, said chain duct open on said stowing side for discharge of fine material, said rolled guide rail having a leg forming the sealing strip, and resting on a support plate which is fastened to the top of said stowing side profile of said trough sections and forming, on said stowing side, widened parts of said side profile.

22. An arrangement as defined in claim 21, wherein said rolled guide rail extends over the entire length of said trough section.

23. An arrangement as defined in claim 21, wherein said chain duct is open at its bottom as well as at a stowing side delimitation for the discharge of said fine material to said stowing side.

24. An arrangement as defined in claim 21, wherein said guide rail is profiled roughly in the shape of a U-section with downwards extending legs of different lengths, wherein the longer stowing side leg forms said sealing strip and in the area underneath said chain duct and is fixed to said trough section or to parts attached to the latter on its stowing side.

25. An arrangement as defined in claim 21, wherein said chain support for said horizontal chain links of said drive gear chain is formed by support strips arranged at a lateral distance from one another such that upright chain links of said drive gear chain engage in a gap-like space between said support strips.

26. An arrangement as defined in claim 25, including a chain duct holding down strip which covers the stowing side legs of said horizontal chain links of said drive gear chain, said holding down strip arranged in a detachable manner.

27. An arrangement defined in claim 26, wherein the stowing side profiles of the trough sections as attachable parts, upwards projecting bracket plates are fastened arranged at a distance from one another, which plates have recesses which delimit said chain duct on said stowing side and at the bottom, wherein the spaces between the bracket plates form said fine material outlet openings.

28. An arrangement as defined in claim 27, including a chain duct holding down strip which covers the stowing side legs of said horizontal chain links of said drive gear chain, said holding down strip arranged in a detachable manner.

29. An arrangement as defined in claim 21, including a chain duct holding down strip which covers the stowing side legs of said horizontal chain links of said drive gear chain, said holding down strip arranged in a detachable manner.

30. An arrangement defined in claim 21, wherein the stowing side profiles of the trough sections as attachable parts, upwards projecting bracket plates are fastened arranged at a distance from one another, which plates have recesses which delimit said chain duct on said stowing side and at the bottom, wherein the spaces between the bracket plates form said fine material outlet openings.

31. An arrangement as defined in claim 21, wherein said horizontal chain links have a greater length and pitch than the upright chain links and have outer end faces which include flat surfaces extending roughly orthogonally to the axis of said drive gear chain.

32. A drive gear and guide arrangement for a mining machine, which operates above a chain scraper conveyor, having a guide rail arranged on a trough section of said chain scraper conveyor, on the stowing side, at a level above said trough section, said guide rail extending alongside said chain scraper conveyor forming a chain duct for a drive gear chain for the moving forward of said mining machine, said guide rail including a profile lug which engages over horizontal chain links of said drive gear chain and holds said chain links on a chain support in said chain duct, said guide rail having a rolled profile which forms a sealing strip that closes off said chain duct of the drive gear chain on the side of the conveyor, said chain duct open on said stowing side for discharge of fine material, and chain duct for said drive gear chain is formed on its stowing side and at its bottom by separate parts attached to said trough sections, which parts form a fine material outlet opening, and to which parts said rolled guide rail is connected by welding.

33. An arrangement as defined in claim 32, wherein said rolled guide rail extends over the entire length of said trough section.

34. An arrangement as defined in claim 32, wherein said chain duct is open at its bottom as well as at a stowing side delimitation for the discharge of said fine material to said stowing side.

35. An arrangement as defined in claim 32, wherein said guide rail is profiled roughly in the shape of a U-section with downwards extending legs of different lengths, wherein the longer stowing side leg forms said sealing strip and in the area underneath said chain duct and is fixed to said trough section or to pans attached to the latter on its stowing side.

36. An arrangement as defined claim 32, wherein said rolled guide rail resting with its base or with its leg which forms said sealing strip on the trough section side profile on said stowing side.

37. An arrangement as defined in claim 32, wherein said rolled guide rail having a leg forming the sealing strip, rests on a support plate which is fastened to the top of said stowing side profile of said trough sections and forms, on said stowing side, widened pans of said side profiles.

38. An arrangement as defined in claim 32, wherein said chain support for said horizontal chain links of said drive gear chain is formed by support strips arranged at a lateral distance from one another such that upright chain links of said drive gear chain engage in a gap-like space between said support strips.

39. An arrangement as defined in claim 32, including a chain duct holding down strip which covers the stowing side legs of said horizontal chain links of said drive gear chain, said holding down strip arranged in a detachable manner.

40. An arrangement defined in claim 32, wherein the stowing side profiles of the trough sections as attachable pans, upwards projecting bracket plates are fastened arranged at a distance from one another, which plates have recesses which delimit said chain duct on said stowing side and at the bottom, wherein the spaces between the bracket plates form said fine material outlet openings.

41. A drive gear and guide arrangement for a mining machine, which operates above a chain scraper conveyor, having a guide rail arranged on a trough section of said chain scraper conveyor, on the stowing side, at a level above said trough section, said guide rail extending alongside said chain scraper conveyor forming a chain duct for a drive gear chain for the moving forward of said mining machine, said guide rail including a profile lug which engages over horizontal chain links of said drive gear chain and holds said chain links on a chain support in said chain duct, said guide rail having a rolled profile which forms a sealing strip that closes off said chain duct of the drive gear chain on the side of the conveyor, said chain duct open on said stowing side for discharge of fine material, and wherein to the stowing side profiles of the trough sections as attachable parts, upwards projecting bracket plates are fastened arranged at a distance from one another, which plates have recesses which delimit said chain duct on said stowing side and at the bottom, wherein the spaces between the bracket plates form said fine material outlet openings.

42. An arrangement as defined in claim 41, wherein said rolled guide rail extends over the entire length of said trough section.

43. An arrangement as defined in claim 41, wherein said chain duct is open at its bottom as well as at a stowing side delimitation for the discharge of said fine material to said stowing side.

44. An arrangement as defined in claim 41, wherein said guide rail is profiled roughly in the shape of a U-section with downwards extending legs of different lengths, wherein the longer stowing side leg forms said sealing strip and in the area underneath said chain duct and is fixed to said trough section or to parts attached to the latter on its stowing side.

45. An arrangement as defined in claim 41, wherein said chain support for said horizontal chain links of said drive gear chain is formed by support strips arranged at a lateral distance from one another such that upright chain links of said drive gear chain engage in a gap-like space between said support strips.

46. An arrangement defined in claim 45, wherein said lateral distance is continuous over the trough section length.

47. An arrangement as defined in claim 45, including a chain duct holding down strip which covers the stowing side legs of said horizontal chain links of said drive gear chain, said holding down strip arranged in a detachable manner.

48. An arrangement as defined in claim 41, including a chain duct holding down strip which covers the stowing side legs of said horizontal chain links of said drive gear chain, said holding down strip arranged in a detachable manner.

49. An arrangement as defined in claim 48, including a chain duct holding down strip which covers the stowing side legs of said horizontal chain links of said drive gear chain, said holding down strip arranged in a detachable manner.

50. An arrangement defined in claim 48, wherein said rolled guide rail legs which forms said sealing strip is connected to said bracket plates by welding.

51. An arrangement as defined in claim 41, wherein said horizontal chain links have a greater length and pitch than the upright chain links and have outer end faces which include flat surfaces extending roughly orthogonally to the axis of said drive gear chain.

52. A drive gear and guide arrangement for a mining machine, which operates above a chain scraper conveyor, having a guide rail arranged on a trough section of said chain scraper conveyor, on the stowing side, at a level above said trough section, said guide rail extending alongside said chain scraper conveyor forming a chain duct for a drive gear chain for the moving forward of said mining machine, said guide rail including a profile lug which engages over horizontal chain links of said drive gear chain and holds said chain links on a chain support in said chain duct, said guide rail having a rolled profile which forms a sealing strip that closes off said chain duct of the drive gear chain on the side of the conveyor, said rolled profile roughly in the shape of a U-section comprising of two downwardly extending legs of different length, the longer of said two legs forming a sealing strip and is connected to said trough section underneath said chain duct, said U-section providing a connecting surface for said mining machine, and said chain duct open on said stowing side for discharge of fine material.

53. An arrangement as defined in claim 52, wherein said rolled guide rail extends over the entire length of said trough section.

54. An arrangement as defined in claim 52, wherein said chain duct is open at its bottom as well as at a stowing side delimitation for the discharge of said fine material to said stowing side.

55. An arrangement as defined in claim 52, wherein said chain support for said horizontal chain links of said drive gear chain is formed by support strips arranged at a lateral distance from one another such that upright chain links of said drive gear chain engage in a gap-like space between said support strips.

56. An arrangement defined in claim 55, wherein said lateral distance is continuous over the trough section length.

57. An arrangement as defined in claim 52, including a chain duct holding down strip which covers the stowing side legs of said horizontal chain links of said drive gear chain, said holding down strip arranged in a detachable manner.

* * * * *